US010941556B2

(12) United States Patent
Christensen et al.

(10) Patent No.: US 10,941,556 B2
(45) Date of Patent: Mar. 9, 2021

(54) WASTE TRANSFER SYSTEM FOR A TOILET OF A PUBLIC TRANSPORT VEHICLE

(71) Applicant: ALTE TECHNOLOGIES S.L.U., Lliçà De Vall (ES)

(72) Inventors: Lars Henrik Christensen, Lliçà De Vall (ES); Dídac Puebla Ribas, Lliçà De Vall (ES)

(73) Assignee: ALTE TECHNOLOGIES S.L.U.

( * ) Notice: Subject to any disclaimer, the term of this patent is extended or adjusted under 35 U.S.C. 154(b) by 34 days.

(21) Appl. No.: 16/461,080

(22) PCT Filed: Nov. 15, 2017

(86) PCT No.: PCT/EP2017/079280
§ 371 (c)(1),
(2) Date: May 15, 2019

(87) PCT Pub. No.: WO2018/091507
PCT Pub. Date: May 24, 2018

(65) Prior Publication Data

US 2020/0056362 A1 Feb. 20, 2020

(30) Foreign Application Priority Data

Nov. 15, 2016 (EP) ..... 16198827

(51) Int. Cl.
*E03F 1/00* (2006.01)
*B61D 35/00* (2006.01)

(52) U.S. Cl.
CPC ..... *E03F 1/006* (2013.01); *B61D 35/007* (2013.01)

(58) Field of Classification Search
CPC .. E03F 5/016; E03F 3/10; E03F 1/006; B61D 35/007; Y10T 137/86871; Y10T 137/86863; Y10T 137/86823
(Continued)

(56) References Cited

U.S. PATENT DOCUMENTS 3,489,178 A * 1/1970 Kice ..... B65G 53/56 406/183
3,597,769 A * 8/1971 Brainard, II ..... E03D 5/014 4/322

(Continued)

FOREIGN PATENT DOCUMENTS

| | | |
|---|---|---|
| EP | 0 584 031 | 2/1994 |
| EP | 0 763 633 | 3/1997 |
| EP | 1 013 838 | 6/2000 |

*Primary Examiner* — Charles Cheyney
(74) *Attorney, Agent, or Firm* — Ice Miller LLP

(57) ABSTRACT

Waste transfer system for a toilet of a public transport vehicle that discharges into an on-board waste aerated storage tank, comprising a waste intermediate tank (1), means for generating negative or positive pressure inside said waste intermediate tank (1), and a discharge valve means (3,5,6,7) to regulate the flow through a first waste passage (8) between a toilet bowl (2) and said waste intermediate tank (1) and through a second waste passage (11) between said waste intermediate tank (1) and said waste storage tank, characterized in that said discharge valve means comprise a multi-port discharge valve (3) connectable to an inlet/outlet port (4) of the waste intermediate tank (1), said multi-port discharge valve (3) being configured to provide, in a first working position, direct communication between said toilet bowl (2) and said waste intermediate tank (1) when negative pressure is supplied inside said waste intermediate tank (1) and to provide, in a second working position, direct communication between the waste intermediate tank (1) and the waste storage tank when positive pressure is supplied in the said waste intermediate tank (1).

20 Claims, 8 Drawing Sheets

(58) Field of Classification Search
USPC ..... 4/434, 431, 323, 321; 137/625.47, 137/625.46, 625.41
See application file for complete search history.

(56) References Cited

U.S. PATENT DOCUMENTS 4,398,562 A * 8/1983 Saarem ..... F16K 31/041 137/625.47
4,561,132 A * 12/1985 Lew ..... A47K 11/02 4/420
4,669,503 A * 6/1987 McGarrity ..... E03F 7/04 137/625.41
4,819,279 A * 4/1989 Sigler ..... E03F 1/006 4/300
5,133,853 A * 7/1992 Mattsson ..... E03F 1/006 210/104
5,273,073 A * 12/1993 Romanchik ..... F16K 11/0853 137/625.46
5,396,668 A * 3/1995 Haatanen ..... E03F 1/006 4/321
6,006,766 A * 12/1999 Soulages ..... E03F 9/00 134/166 C
6,186,471 B1 * 2/2001 Genga ..... F16K 31/046 251/129.12
6,216,285 B1 * 4/2001 Olin ..... E03F 1/006 4/321
6,910,231 B2 * 6/2005 Breiing ..... E03D 5/00 4/319
8,185,977 B2 * 5/2012 Seibt ..... E03F 1/006 4/431

* cited by examiner

WASTE TRANSFER SYSTEM FOR A TOILET OF A PUBLIC TRANSPORT VEHICLE

CROSS-REFERENCE TO RELATED PATENT APPLICATIONS

This is a U.S. National Phase Application under 35 U.S.C. § 371 of International Patent Application No. PCT/EP2017/079280, filed Nov. 15, 2017, and claims priority to 16198827.4 filed Nov. 15, 2016, which is incorporated herein by reference in its entirety. The International Application was published on May 24, 2018, as International Publication No. WO 2018/091507 A1.

The present invention generally relates to a waste transfer system for a toilet of a public transport vehicle that discharges into an on-board waste storage tank. In particular, it relates to a waste transfer system for a toilet, or similar sanitary appliance, that discharges into an on-board aerated waste storage tank that may subjected to biological waste treatment.

BACKGROUND OF THE INVENTION

Moving installations like railway passenger coaches are being fitted more and more with WC cabins where the toilet bowls does discharge into an on-board waste storage tank, thus avoiding discharge to the railways tracks.

It is known to use a first type of waste storage tank with constant vacuum where the waste transfer from the toilet bowl to the waste storage tank is by suction from the said waste storage tank. EP0584031 discloses a waste transfer system including one of these type of waste storage tanks where a discharge valve is arranged between the toilet bowl and the said waste storage tank to open or close the passage of fluid through the waste storage tank.

It is also known to use a second type of waste storage tank provided with atmospheric pressure. In this second type case, the system used to transfer the waste from the bowl to the aerated waste storage tank forms part of each toilet bowl and includes a small intermediate waste tank next to each bowl. This intermediate waste tank is used to first generate a local vacuum to transfer the waste from the toilet bowl to the waste intermediate tank by the opening of a valve located between the toilet bowl and the said waste intermediate tank. Having accomplished this, this valve is closed, the intermediate tank is pressurized and a second valve located at the exit of the waste intermediate tank is opened allowing the waste to be transferred through an interconnecting tube to the aerated waste storage tank.

The use of waste transfer systems with aerated waste storage tanks although more complex and demanding than waste transfer systems with vacuum waste storage tanks, have the advantage that allow the use of biological waste treatments which extend the emptying periods of the waste storage tanks to weeks or even months. Nevertheless, these waste transfer systems have the drawback that they have a high requirement of room needed for the installation next to each toilet bowl.

It is, therefore, necessary to provide an alternative to the aerated waste transfer systems of the state of the art which allow the use of aerated waste storage tanks and reduce the requirement of room needed for the installation so that a more compact solution is obtained.

DESCRIPTION OF THE INVENTION

To that end, the present invention relates to a waste transfer system that discharges into an on-board waste aerated storage tank, which comprises, in a known manner;

- a waste intermediate tank,
- a first waste passage arranged in use to communicate a toilet bowl and said intermediate tank,
- a second waste passage arranged in use to communicate said intermediate tank and said waste storage tank,
- means for generating negative or positive pressure inside said waste intermediate tank so as to cause the waste to be transferred either to the said waste intermediate tank through said first waste passage, or to the storage tank through said second waste passage, and
- a discharge valve means (3,5,6,7) arranged to regulate the flow through said first waste passage (8) and through said second waste passage (11).

In contrast to the known waste transfer systems, in the one proposed by the present invention, in a characteristic manner, the discharge valve means comprise a multi-port discharge valve connected to a port of the waste intermediate tank, said discharge valve comprising a valve element with at least three ports adapted for opening or closing the first waste passage of fluid in a first working position, and for opening or closing the second waste passage of fluid in a second working position, the system including a process and control unit configured to activate the actuation of said valve element from said first working position to the second working position, to provide, in said first working position, direct fluid communication between the toilet bowl and the waste intermediate tank when negative pressure is supplied inside the waste intermediate tank, and to provide, in the second working position, direct fluid communication between the waste intermediate tank and the aerated waste storage tank when positive pressure is supplied in the said waste intermediate tank.

The multi-port discharge valve connected to an inlet/outlet port of the waste intermediate tank allows to overcome the above mentioned shortcoming of the prior art aerated waste transfer systems. Indeed, it has been found that the requirement of room is significantly reduced because this multi-port discharge valve may be installed next to each toilet bowl beside the waste intermediate tank, and the design of this waste intermediate tank may be improved to take advantage of extra free room available below the toilet bowl. On the other hand, a waste transfer system with a higher reliability is obtained because the claimed waste system facilitates the location of the blockages caused by foreign bodies in the toilet such as syringes, sanitary towels, tampons, disposable razors, among others.

For a preferred embodiment, the multi-port discharge valve is connected to a single inlet/outlet port of the waste intermediate tank and, more preferably, said multi-port discharge valve is a single 3-way discharge valve, or a discharge valve with three ports, connected to an inlet/outlet port of the intermediate waste tank.

For another embodiment, the discharge valve is connected to a first inlet port of the waste intermediate tank and to a separated second outlet port of the waste intermediate tank, and said discharge valve comprises a valve element with at least four ports adapted for opening or closing the first waste passage of fluid in the first working position and for opening or closing the second waste passage of fluid in the second working position.

According to one embodiment, the multi-port discharge valve, for example, the above mentioned 3-way valve with three ports, or with four ports, comprises a valve body and a rotating element adapted for opening or closing the passage of fluid between said toilet bowl and said intermediate waste tank in said first working position, and adapted for opening or closing the passage of fluid between said intermediate waste tank and said waste storage tank in said second working position. The valve discharge means further comprise driving means for said rotating element.

In an example, said valve body is of synthetic material and, advantageously, said rotating element is housed in a cavity of said valve body.

More preferably, said rotating element is provided with a first conduit which, when the valve is in said first working position, connects a first port to a second port of the valve housing, and provided with a second conduit which, when the valve is in said second working position, connects the second port to a third port of the valve body. The rotating element is adapted to avoid the communication between the toilet bowl and the waste storage tank when working in either said first or second positions.

For one embodiment, this rotating element is a ball housed inside the valve body, said ball being provided with said first and second conduits to connect the first port and second port of the valve body in a first working position, or the second port and the third port of the valve body in a second working position.

For other preferably embodiment, this rotating element can also be, for example, a tubular element provided with an interior separation plate adapted to avoid the direct communication between the toilet bowl and the waste storage tank in either said first or second working positions of the discharge valve. Said separation plate defines inside the said tubular element said first and second conduits of passage of fluid in said first and second working positions.

For a particular implementation of said preferably embodiment, said valve discharge means comprise a drive motor for said rotating element, and said rotating element comprises means for engaging a shaft of said drive motor. Advantageously, the shaft of said drive motor is arranged so as to directly engage an element, such as a gear wheel, provided in the outer surface of said rotating element. This arrangement helps obtaining a more compact solution.

For a preferably embodiment, the discharge valve means comprise a plurality of positioning sensor readings attached to said rotating element. For example, these sensor readings may be integrated in a plurality of notches provided in the body of the rotating element and may cooperate with sensors provided in the system and governed by a central controller unit.

According to one embodiment, the claimed waste transfer system comprises a waste cutting element arranged between the adjacent surfaces of the second port of the valve housing and the rotating element. This cutting element may be configured by way of a steel-ring located at the outlet part of the valve body connecting to the intermediate tank and is so arranged that eventual solid parts upon valve closure are conveniently cut thus no preventing the valve from closing.

Summarizing, the present invention relates to a waste transfer system that discharges into an on-board waste aerated storage tank, which comprises, in a known manner, a waste intermediate tank, means for generating negative or positive pressure inside said intermediate waste tank, and a discharge valve means to regulate the flow through a first waste passage between said toilet bowl and said intermediate waste tank and through a second waste passage between said intermediate waste tank and said waste storage tank. The system is characterised in that, the said discharge valve means comprise a multi-port discharge valve, for example a multi-port discharge valve of three ports, connected to an inlet/outlet port of the waste intermediate tank. The said multi-port discharge valve is configured to provide, in a first working position, direct communication between said toilet bowl and said waste intermediate tank when negative pressure is supplied inside said waste intermediate tank, and to provide, in a second working position, direct communication between the waste intermediate tank and the waste storage tank when positive pressure is supplied in the said waste intermediate tank.

BRIEF DESCRIPTION OF THE DRAWINGS

The previous and other advantages and features will be more fully understood from the following detailed description of embodiments, with reference to the attached drawings, which must be considered in an illustrative and non-limiting manner, in which.

DESCRIPTION OF A PREFERRED EMBODIMENT

Figure 1:
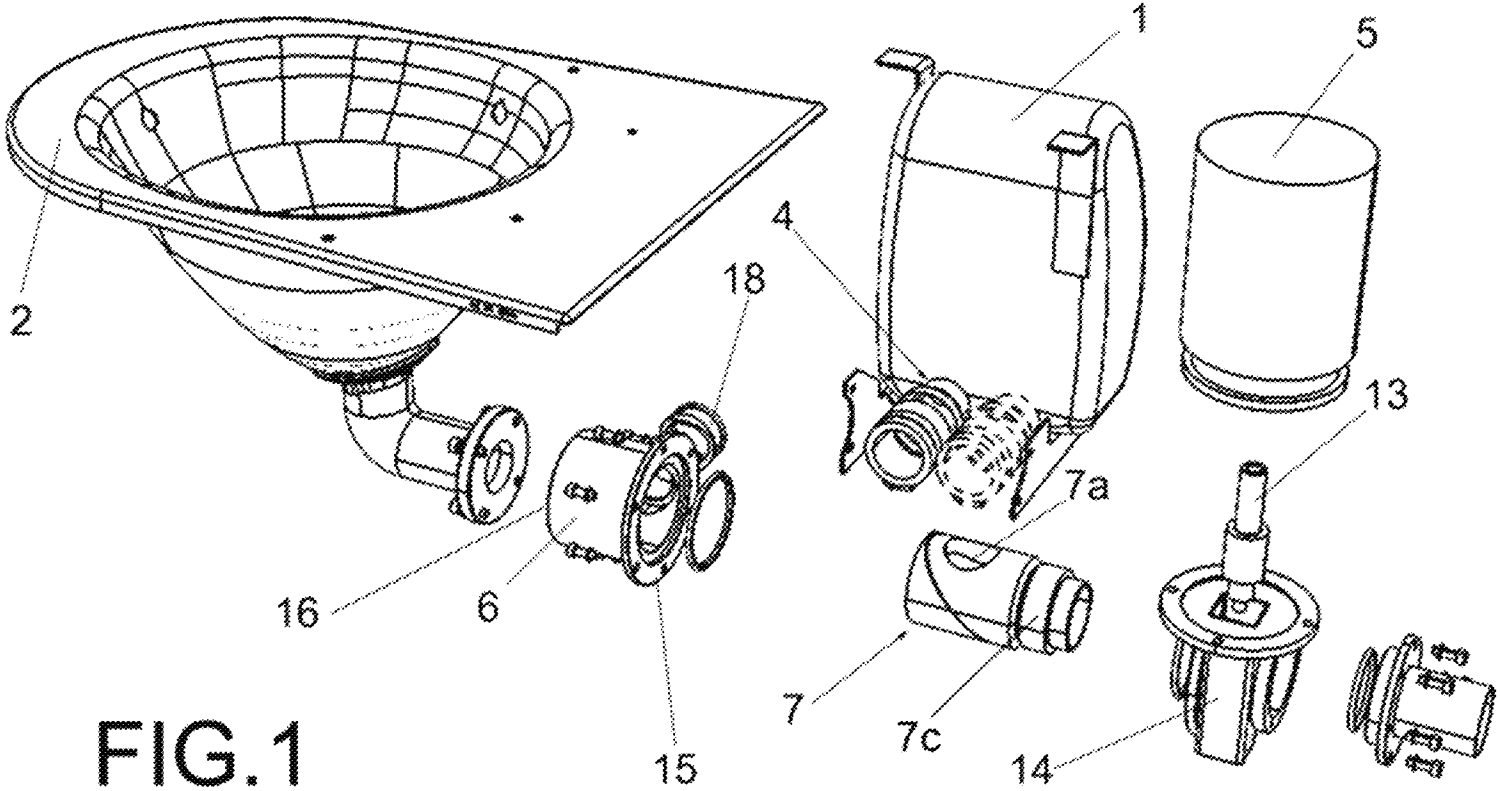
FIG. 1 shows a first exploded perspective view of the waste transfer system according to an embodiment of the invention where the aerated waste storage tank has not being represented.

As shown in the appended Figures, the present invention relates to a waste transfer system for a toilet of a WC cabin of a public transport vehicle, for example a toilet of a railway vehicle that discharges into an on-board waste aerated storage tank. The system comprises a waste intermediate tank 1 for temporarily receiving the waste coming from a toilet bowl 2, a multi-port discharge valve 3 connected to an inlet/outlet port 4, 4*a*, 4*b* of the said waste intermediate tank 1, and a drive motor 5 to actuate said multi-port discharge valve 3. The waste system further includes means (not shown) for generating negative or positive pressure inside the said waste intermediate tank 1.

In the claimed invention the multi-port discharge valve 3 is configured to provide, in a first working position, direct communication between the toilet bowl 2 and said waste intermediate tank 1 when negative pressure is supplied inside said waste intermediate tank 1, and configured to provide, in a second working position, direct communication between the waste intermediate tank 1 and the waste storage tank (not shown) when positive pressure is supplied in the said waste intermediate tank 1.

Figure 2:
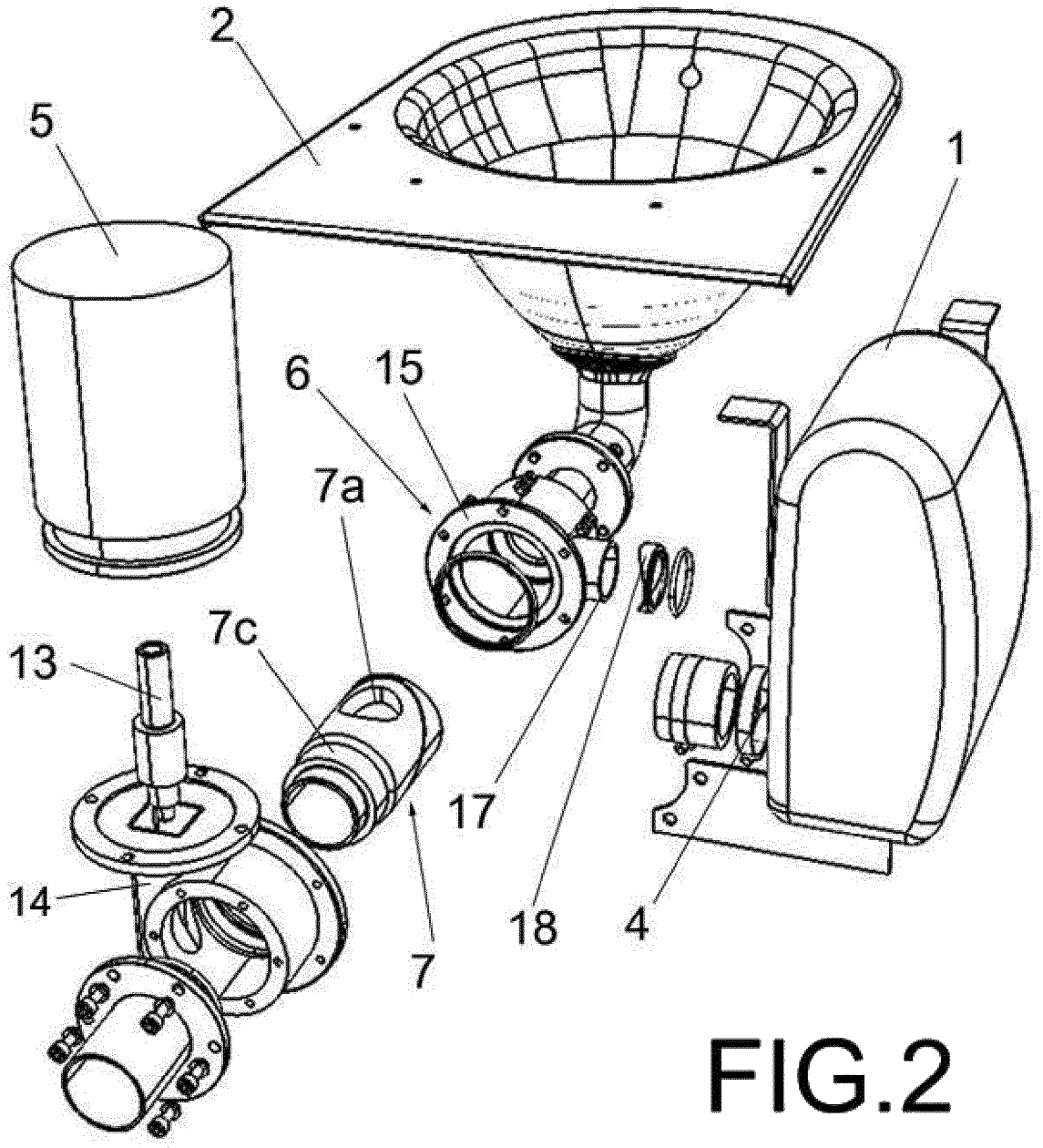
FIG. 2 shows a further exploded different perspective view of the same embodiment of the invention as the one of FIG. 1.
Figure 3:
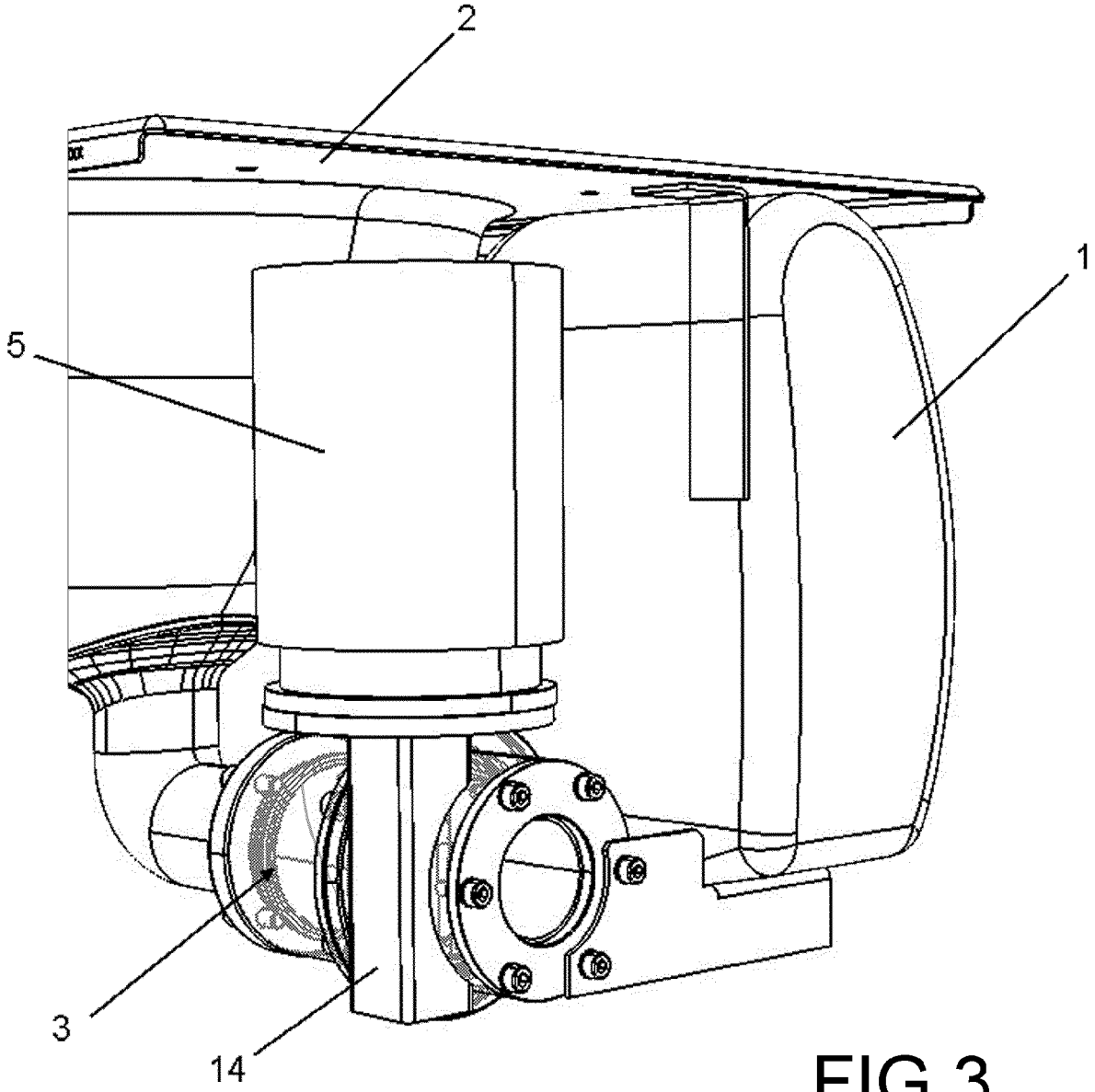
FIG. 3 shows a perspective view of a portion of the toilet bowl, the waste intermediate tank and the discharge valve means of the invention for the embodiment of FIGS. 1 and 2.
Figure 4:
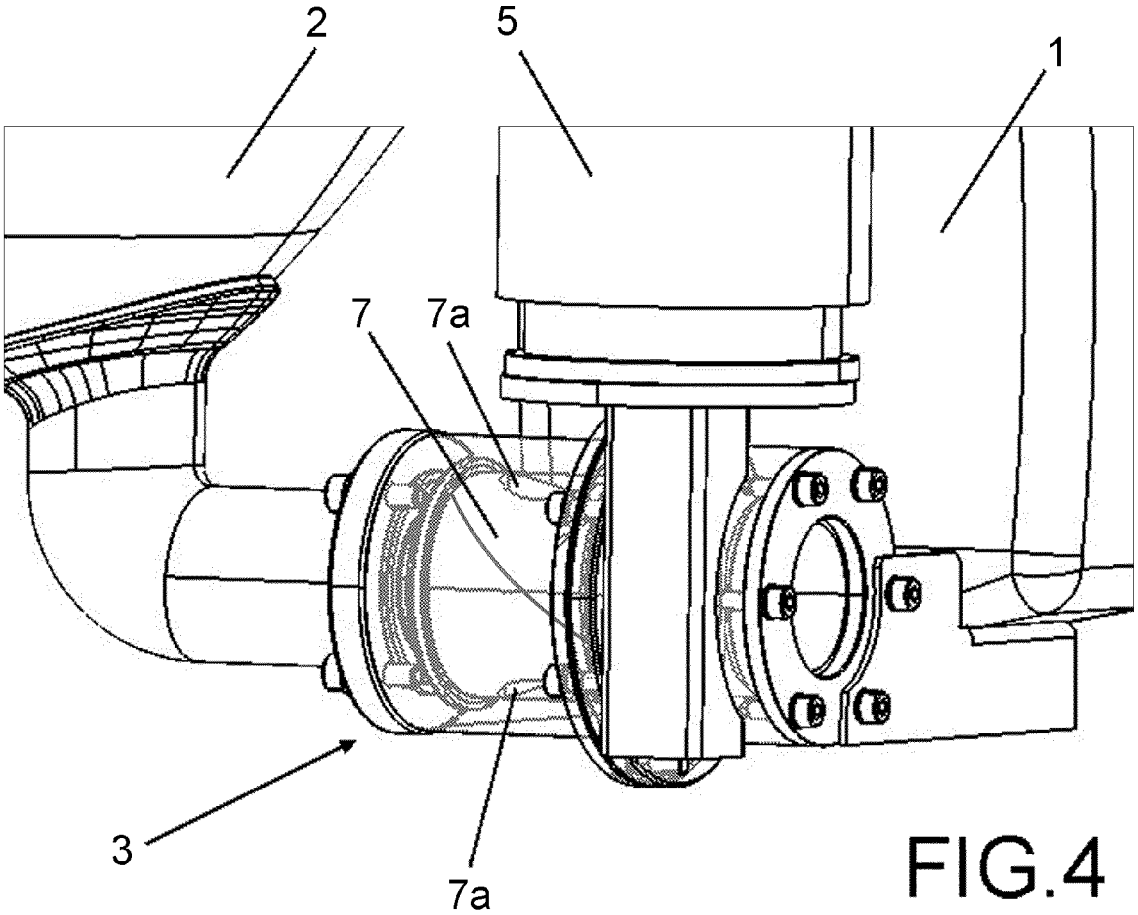
FIG. 4 shows a detailed view of the discharge valve means as shown in FIG. 3 wherein the valve body has been depicted transparent to see inside the tubular rotating element.

As shown in FIGS. 1 and 2, the multi-port discharge valve 3 comprises a valve body 6, preferably a valve body of synthetic material, and a valve element configured in the shape of a rotating element 7 to be housed inside a cavity of said valve body 6. The said rotating valve element 7, preferably a rotating element of steel or aluminium material, is adapted for opening or closing, in said first working position, a passage of fluid between the toilet bowl 2 and the said waste intermediate tank 1, and also adapted for opening or closing, in said second working position, a passage of fluid between the waste intermediate tank 1 and the said aerated waste storage tank (not shown).

For the illustrated embodiment of FIGS. 1 to 5, the multi-port discharge valve 3 is a single 3-way discharge valve, or a valve of three ports, connected to a single inlet/outlet port 4 of the waste intermediate tank 1. However, for other embodiments, like the one schematically shown in FIG. 6, the multi-port valve is a 3-way discharge valve with four ports, connected to a first inlet port 4*a* of the waste intermediate tank 1 and to a separated outlet port 4*b* of the same waste intermediate tank 1. This embodiment has the advantage of avoiding an accidental waste back-flush, and confers more safety to the system.

According to the embodiment of FIGS. 1 to 5, the said rotating valve element 7 is configured in the shape of a tubular element provided with a pair of through holes 7*a* and an interior separation plate 7*b* adapted to avoid direct communication between the toilet bowl 2 and the waste storage tank (not shown) in any working position of the discharge valve 3.

Figure 5A:
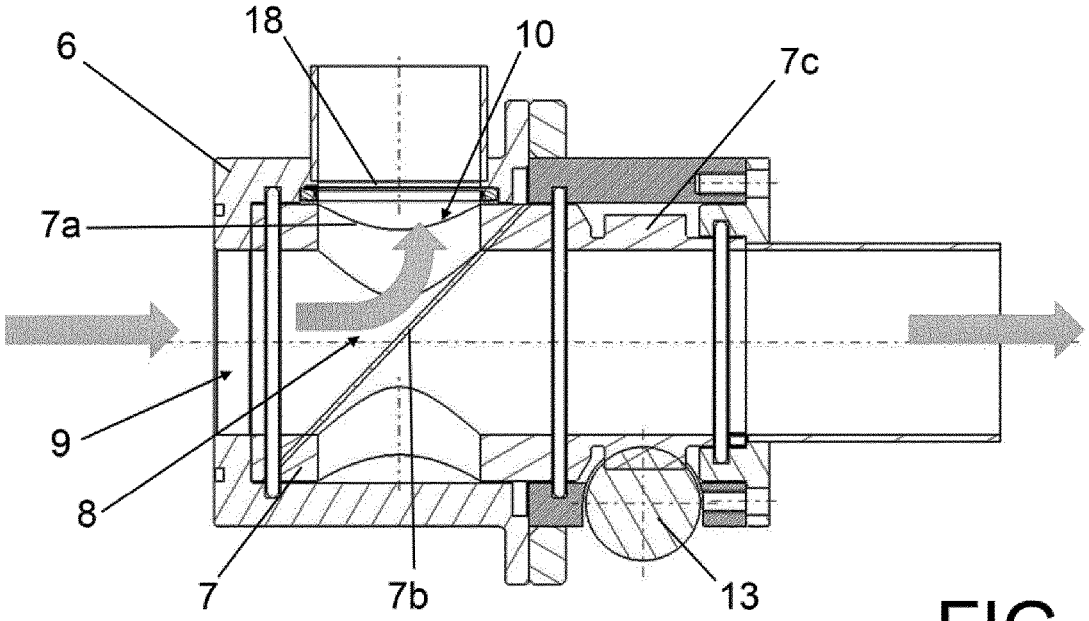
FIGS. 5*a* to 5*c* are schematic sections of the discharge valve representing respectively, a first working position, a second working position and a close off rest position of the multi-port discharge valve according to the embodiment as shown in FIGS. 1 to 4.
Figure 5B:
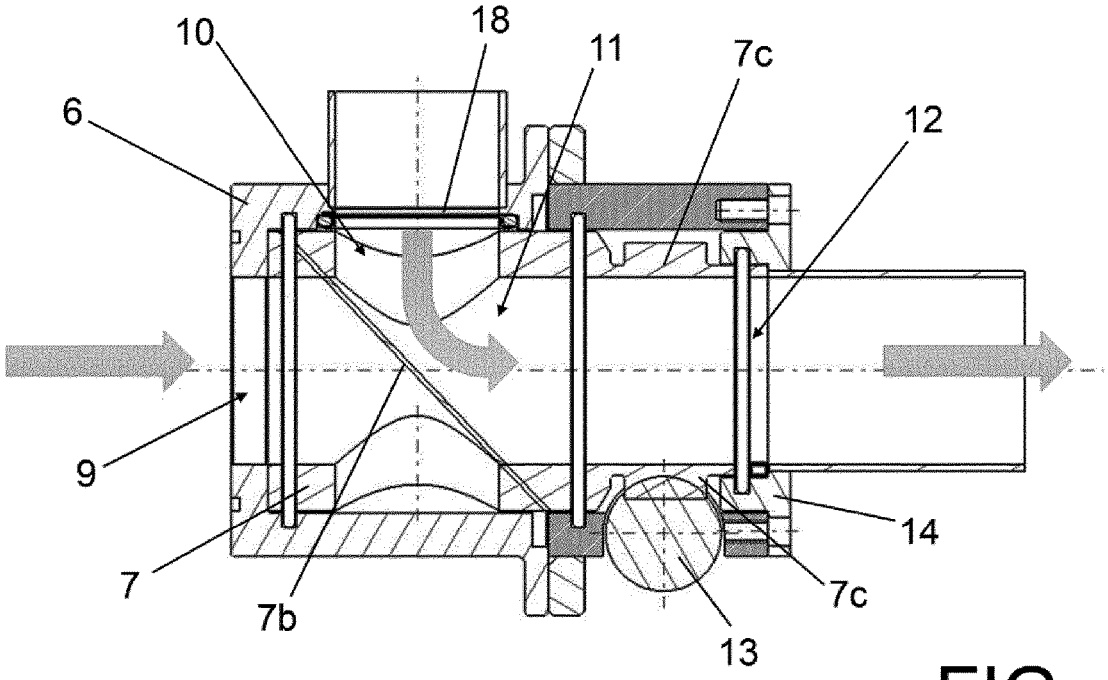
Figure 5C:
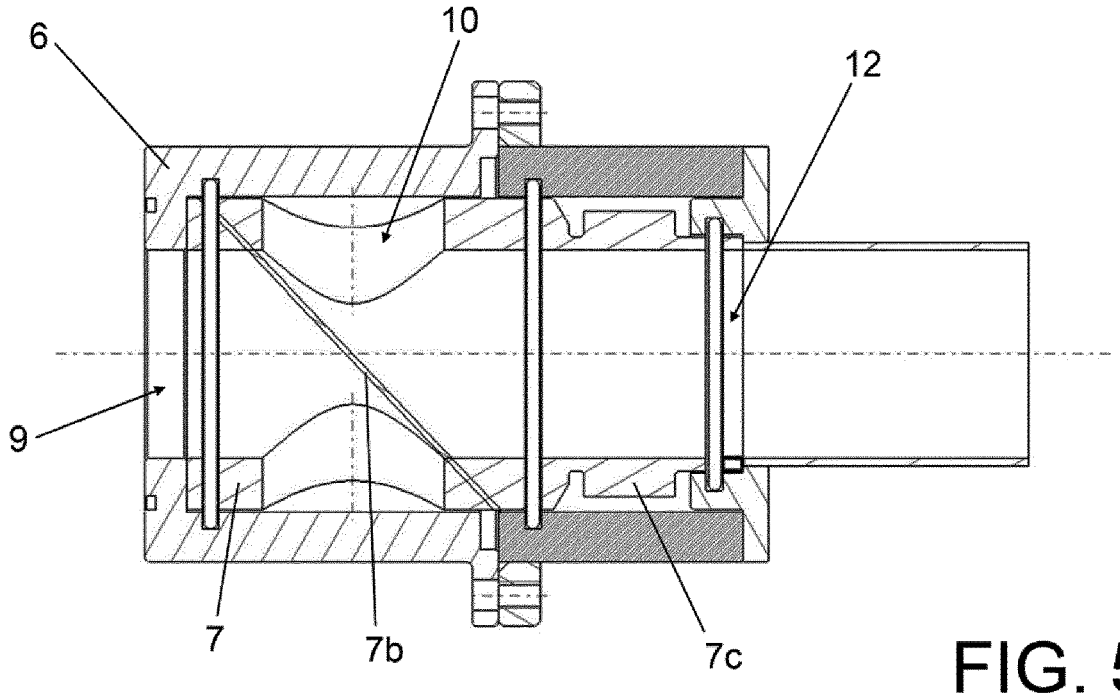
Figure 6:
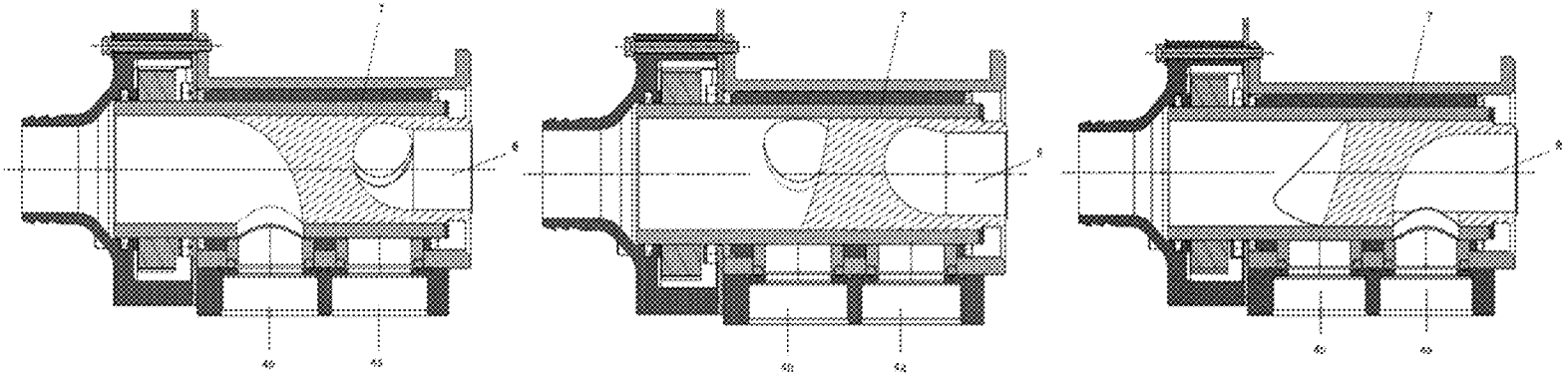
FIG. 6 shows a schematic representation showing the functioning of a discharge valve connected to a first inlet port of the waste intermediate tank and to a separated second outlet port of the waste intermediate tank.

FIGS. 5*a* and 5*b* depict two working positions of the rotating valve element 7 of the discharge valve 3 where it can be seen, in FIG. 5*a*, the interior separation plate 7*b* defining inside the said tubular element a first conduit or waste passage 8 that connects a first port 9 of the valve body 6 to a second port 10 of the valve body 6. In FIG. 5*b*, the same interior separation plate 7*b* defines inside the said tubular element a second conduit or waste passage 11 that connects the second port 10 of the valve body 6 to a third port 12 of the valve body 6. FIG. 5*c* shows a close off rest position of the discharge valve 3 wherein the rotating valve element 7 close off the connections with the waste intermediate tank 1 and the waste storage tank (not shown).

In the particular illustrated embodiment of FIGS. 1 to 5, the rotating valve element 7 comprises an end section 7*c* provided with a gear (not shown) configured to be meshed with a worm-gear shaft 13 of the drive motor 5. As can be seen in the FIGS. 3 and 4, for this particular implementation of the illustrated embodiment, the shaft 13 of the drive motor 5 is arranged so as to directly engage the gear provided in the rotating valve element 7. At this end, the drive motor 5 has been provided with a housing 14 for receiving the geared end section 7*c* (geared not shown) of the rotating valve element 7.

The claimed waster transfer system is provided with means to ensure optimum watertightness between the elements which undergo relative movement. FIGS. 1 and 2 show flanges 15, 16 and 17 of the valve body 6 for connection to the toilet bowl 2, to the waste intermediate tank 1 and to the housing 14 of the drive motor 5. Each of said flanges is provided with a water-thigh seal receivable in a recess formed on the valve body 6 itself.

In the particular case of the connection flange 17 to the waste intermediate tank 1, a waste cutting element 18 has been arranged between the adjacent surfaces of the second port 10 of the valve body 10 and the rotating valve element 7 as shown in FIG. 5*a*. The said cutting element 18 is arranged so that eventual solid parts upon valve closure are conveniently cut thus no preventing the valve from closing.

It follows a description of the mode of operation of the claimed waster transfer system. The different elements of the system are activated from a control panel (not shown) either directly or by means of pneumatic electrovalves fed by a compressed air source (not shown) through pressure regulators (not shown). The control panel receives signals from a manual switch arranged next to each toilet bowl 2, which activates the operation cycle.

After having used the toilet bowl 2, the user of the WC cabin will push the manual switch next to the toilet bowl 2 which will activate the drive motor 5 for actuating the rotation of the rotating valve element 7 of the multi-port discharge valve 2 from a rest position to the first working position (see, FIG. 5*a*). In this first working position, a positioning sensor reading (not shown) of the rotating valve element 7, which is associated to a processing and control unit of the system, will activate an ejector (not shown) to generate negative pressure (partial vacuum) inside the waste intermediate tank 1 so as to cause the waste to be transferred to the said waste intermediate tank 1.

Once the waste has been transferred to the waste intermediate tank 1 and after a predetermined period of time, the processing and control unit will activate the drive motor 5 for actuating the rotation of the rotating valve element 7 from the first working position to the second working position (see, FIG. 5*b*). In this second working position, a position sensor reading (not shown) of the rotating valve element 7 will activate the ejector to generate positive pressure inside the waste intermediate tank 1 so as to cause the waste to be transferred to the waste storage tank (not shown). As previously stated, in either the first or the second working positions, direct communication between the toilet bowl 2 and the waste storage tank (not shown) is avoided. In the rest position of the discharge valve 2, the rotating valve element 7 close off the communication of the toilet bowl 2 to the waste intermediate tank 1 and the aerated waste storage tank (not shown).

The above-mentioned ejector (not shown) is known in the state of the art. Its operation is based on forcing air to pass through a nozzle and using the negative pressure created therein to extract air from the waste intermediate tank 1 by the Venturi effect and thus creating a partial vacuum. The air supplied and the air extracted from the waste intermediate tank 1 is expelled to the atmosphere.

Advantageously, the present invention allows to obtain a waste transfer system that stands out from those currently available in the market in terms of efficiency and reliability because a single discharge valve 3 regulates the flow of the waste to the aerated waste storage tank. Moreover, the system has a lower cost than those offered in the market because it has less components and less operations of maintenance.

A person skilled in the art could introduce changes and modifications in the embodiments described without departing from the scope of the invention as it is defined in the attached claims. For example, although an embodiment of the system has been described wherein the rotating element of the discharge valve is configured in the shape of a tubular element, the same rotating element may be configured in the shape of a ball housed inside a valve body and provided with a plurality of ports. Likewise, although an embodiment of the waste transfer system has been described suitable for a toilet bowl 2 of a WC cabin, the system would also be suitable to transfer waste from a sanitary appliance other than a toilet bowl 2.

The invention claimed is:

1. Waste transfer system for a toilet of a public transport vehicle that discharges into an on-board aerated waste storage tank, comprising a waste intermediate tank, a pressure generating unit for generating negative or positive pressure inside said waste intermediate tank so as to cause the waste to be transferred either to the waste intermediate tank or to the aerated waste storage tank, and a discharge valve unit arranged to selectively regulate the waste flow between a toilet bowl and said waste intermediate tank and between said waste intermediate tank and said aerated waste storage tank, wherein said discharge valve unit comprises a multi-port discharge valve connected to the waste intermediate tank, said multi-port discharge valve comprising a valve body with at least four ports and a rotating valve element rotatably mounted inside the valve body for selectively regulating the waste flow, wherein said rotating valve element is provided with a first conduit or waste passage which, when said rotating valve element is in a first working position, connects a first port to a second port of the valve body for allowing the passage of fluid between said toilet bowl and said waste intermediate tank, and provided with a second conduit or waste passage which, when said rotating valve element is in a second working position, connects a third port with a fourth port of the valve body for allowing the passage of fluid between said waste intermediate tank and said aerated waste storage tank, and wherein said system includes a process and control unit configured to selectively activate actuation of said rotating valve element from said first working position to the second working position, to provide, in said first working position, direct fluid communication between said toilet bowl and said waste intermediate tank when the pressure generating unit generates negative pressure inside said waste intermediate tank, and to provide, in the second working position, direct fluid communication between the waste intermediate tank and the aerated waste storage tank when the pressure generating unit generates positive pressure in the said waste intermediate tank, wherein said port of the waste intermediate tank has a first inlet port and a separated second outlet port, wherein the first port of the valve body is connected to the toilet bowl, the second port of the valve body is connected to the first inlet port of the waste intermediate tank, the third port of the valve body is connected to the separated second outlet port of the waste intermediate tank, and the fourth port of the valve body is connected to the aerated waste storage tank, and wherein said rotating valve element is made and arranged to avoid the communication between the toilet bowl and the aerated waste storage tank when working in either said first or said second working positions.

2. Waste transfer system according to claim 1, wherein said rotating valve element comprises a tubular element provided with an interior separation plate adapted to avoid the direct communication between the toilet bowl and the waste storage tank in either said first or second working positions.

3. Waste transfer system according to claim 1, wherein said valve discharge unit comprises a drive motor for actuating said rotating valve element, and said rotating valve element comprises a mechanism for engaging a shaft of said drive motor.

4. Waste transfer system according to claim 3, wherein the shaft of said drive motor is arranged so that it directly engages an element provided in the rotating valve element.

5. Waste transfer system according to claim 1, wherein said valve discharge unit comprises a waste cutting element arranged between the second port of the valve body and the waste intermediate tank.

6. Waste transfer system according to claim 1, wherein said discharge valve unit comprises a plurality of positioning sensor readings attached to said rotating valve element that cooperate with sensors provided in the system and governed by the process and control unit.

7. Waste transfer system according to claim 1, wherein said valve body is of synthetic material.

8. Waste transfer system according to claim 2, wherein said tubular element is provided with a pair of through holes and said interior separation plate defines inside the tubular element said first conduit or waste passage and said second conduit or waste passage.

9. Waste transfer system according to claim 1, wherein said rotating valve element is configured in the shape of a ball.

10. Waste transfer system for a toilet of a public transport vehicle that discharges into a waste storage tank and that includes an intermediate tank and a pressure generating unit for generating negative or positive pressure inside the intermediate tank to cause waste to be transferred either to the intermediate tank or to the waste storage tank, the system comprising:

a discharge valve unit arranged to selectively regulate waste flow between a toilet bowl and an intermediate tank in a first working position, and to selectively regulate waste flow between the intermediate tank and a waste storage tank in a second working position, wherein the discharge valve unit includes a multi-port valve comprising:

a valve body having a plurality of ports, including a first port arranged to connect to the toilet bowl, a second port arranged to connect to a first port on the intermediate tank, a third port arranged to connect to a second port on the intermediate tank, and a fourth port arranged to connect to the waste storage tank; and a rotating valve element having a plurality of conduits or waste passages, including a first conduit or waste passage arranged, when the multi-port discharge valve unit is in the first working position, to connect the first port of the valve body with the second port of the valve body to allow passage of fluid between the toilet bowl and the intermediate tank, and a second conduit or waste passage arranged, when the multi-port discharge unit is in the second working position, to connect the third port of the valve body with the fourth port of the valve body to allow passage of fluid between the intermediate tank and the waste storage tank, wherein the rotating valve element is arranged to avoid communication between the toilet bowl and the waste storage tank when working in either the first working position or the second working position.

11. Waste transfer system according to claim 10, wherein the rotating valve element comprises a tubular element provided with an interior separation plate adapted to avoid direct communication between the toilet bowl and the waste storage tank in either the first working position or the second working position.

12. Waste transfer system according to claim 10, wherein the discharge valve unit further comprises:

a drive motor having a shaft arranged to actuate the rotating valve element, wherein the rotating valve element comprises a mechanism arranged to engage the shaft of the drive motor.

13. Waste transfer system according to claim 12, wherein the shaft of the drive motor is arranged to engage said mechanism and actuate the rotating valve element.

14. Waste transfer system according to claim 10, wherein the discharge valve unit further comprises a waste cutting element.

15. Waste transfer system according to claim 10, wherein the discharge valve unit further comprises a plurality of positioning sensor readings attached to the rotating valve element.

16. Waste transfer system according to claim 11, wherein the tubular element includes a pair of through holes and the interior separation plate defines inside the tubular element the first conduit or waste passage and the second conduit or waste passage.

17. Waste transfer system according to claim 10, wherein the rotating valve element is configured in the shape of a ball.

18. Waste transfer system for a toilet of a public transport vehicle that discharges into an on-board waste storage tank, comprising an intermediate tank, a pressure generating unit for generating negative or positive pressure inside the intermediate tank so as to cause the waste to be transferred either to the intermediate tank or to the waste storage tank, and a discharge valve unit arranged to selectively regulate the waste flow between a toilet bowl and the intermediate tank and between the intermediate tank and the waste storage tank, wherein said discharge valve unit comprises a multi-port discharge valve connected to an inlet port of the intermediate tank and an outlet port of the intermediate tank, said multi-port discharge valve comprising a valve body with a plurality of ports and a rotating valve element rotatably mounted inside the valve body for selectively regulating the waste flow, wherein said rotating valve element comprises a first conduit or waste passage which, when said rotating valve element is in a first working position, connects a first port to a second port of the valve body for allowing the passage of fluid between said toilet bowl and said inlet port of the intermediate tank, and a second conduit or waste passage which, when said rotating valve element is in a second working position, connects a third port with a fourth port of the valve body for allowing the passage of fluid between said outlet port of the intermediate tank and said waste storage tank, and wherein the rotating valve element is made and arranged to avoid communication between the toilet bowl and the waste storage tank when working in either the first working position or the second working position.

19. Waste transfer system according to claim 18, wherein the rotating valve element comprises a tubular element provided with an interior separation plate adapted to avoid direct communication between the toilet bowl and the waste storage tank in either the first working position or the second working position.

20. Waste transfer system according to claim 18, wherein the rotating valve element is configured in the shape of a ball.

* * * * *